US008436784B2

(12) United States Patent
Jalali Mazlouman et al.

(10) Patent No.: US 8,436,784 B2
(45) Date of Patent: May 7, 2013

(54) RECONFIGURABLE AXIAL-MODE HELICAL ANTENNA

(75) Inventors: Shahrzad Jalali Mazlouman, Vancouver (CA); Alireza Mahanfar, Vancouver (CA); Carlo Menon, Coquitlam (CA); Rodney G. Vaughan, Burnaby (CA)

(73) Assignee: Simon Fraser University, Burnaby (CA)

( * ) Notice: Subject to any disclaimer, the term of this patent is extended or adjusted under 35 U.S.C. 154(b) by 293 days.

(21) Appl. No.: 12/963,489

(22) Filed: Dec. 8, 2010

(65) Prior Publication Data

US 2011/0298688 A1 Dec. 8, 2011

Related U.S. Application Data

(60) Provisional application No. 61/267,792, filed on Dec. 8, 2009.

(51) Int. Cl.
*H01Q 1/36* (2006.01)

(52) U.S. Cl.
USPC ..... 343/895

(58) Field of Classification Search ..... 343/895
See application file for complete search history.

(56) References Cited

U.S. PATENT DOCUMENTS 3,852,759 A * 12/1974 Felsenheld et al. ..... 343/729
4,163,981 A 8/1979 Wilson
5,451,974 A * 9/1995 Marino ..... 343/895
5,892,480 A 4/1999 Killen
6,256,000 B1 * 7/2001 Yanagisawa et al. ..... 343/903

OTHER PUBLICATIONS

John D. Kraus, Helical Beam Antennas for Wide-Band Applications, Proceedings of the I.R.E., Mar. 1948, October issue, I.R.E., New York.
Howard E. King and Jimmy L. Wong, Characteristics of 1 to 8 Wavelength Uniform Helical Antennas, IEEE Transactions on Antennas and Propagation, Mar. 1980.
John D. Kraus and Ronald J. Marhefka, Antennas for All Applications, McGraw-Hill, 1988.
J. Jayender, R. V. Patel, S. Nikumb, and M. Ostojic, Modeling and Control of Shape Memory Alloy Actuators, IEEE Transactions on Control Systems Technology, Mar. 2008, vol. 16, No. 2.
Gangbing Song, Brian Kelly, and Brij N. Agrawal, Active Position Control of a Shape Memory Alloy Wire Actuated Composite Beam, Smart Mater. Struct. 9, Aug. 2000, IOP Publishing Ltd., United Kingdom.
J. S. Chatterjee, Radiation Field of a Conical Helix, Journal of Applied Physics, May 1953, vol. 24, No. 5.

(Continued)

*Primary Examiner* — Tan Ho
(74) *Attorney, Agent, or Firm* — Laurence C. Bonar

(57) ABSTRACT

Novel reconfigurable antennas are provided which may be used to accommodate the requirements for wideband multi-standard handheld communication devices. It is shown that using a shape memory alloy spring actuator, the height of a helical antenna and therefore the pitch spacing and angle can be varied. This can in turn tune the far-field radiation pattern and gain of the antenna dynamically to adjust to new operating conditions. The radiation pattern can further be directed using a two-helix array. Finally, a helical antenna embodiment is implemented and measured using a shape memory alloy actuator. Measurement results confirm that while keeping the centre frequency constant, gain tunability can be attained using this structure.

14 Claims, 18 Drawing Sheets

OTHER PUBLICATIONS

Siavash Haroun Mahdavi and Peter J. Bentley, Evolving Noise Tolerant Antenna Configurations Using Shape Memory Alloys, Date, United Kingdom.

Toki Corporation, Biometal Actuator Dept., Artificial Metal-Based Muscle for Long Stroke Actuators, marketing catalog, available at http://www.toki.co.jp/, Nov. 11, 2009, Japan.

A. Mahanfar, C. Menon. and R.G. Vaughan, Smart Antennas Using Electro-Active Polymers for Deformable Parasitic Elements, Electronic Letters, vol. 44, No. 19, Sep. 11, 2008.

Jennifer T. Bernhard, E. Kiely, and Gregory Washington, A Smart Mechanically Actuated Two-Layer Electromagnetically Coupled Microstrip Antenna with Variable Frequency, Bandwidth, and Antenna Gain, IEEE Transactions on Antennas and Propagation, vol. 49, No. 4, Apr. 2001.

Jennifer T. Bernhard, Reconfigurable Antennas, Synthesis Lectures on Antennas #4, Morgan & Claypool, 2007.

J. Kiriazi, H. Ghali, H. Ragaie, and H. Haddara, Reconfigurable Dual-Band Dipole Antella on Silicon Using Series Mems Switches, IEEE 2003.

D. J. Roscoe, L Shafai, A. Ittipiboon, M. Cuhaci, and R. Douville, Tunable Dipole Antennas, IEEE 1993.

Shing-Hau Chen, Jeen-Sheen Row, and Kin-Lu Wong, Reconfigurable Square-Ring Patch Antenna With Pattern Diversity, IEEE Transactions on Antennas and Propagation, vol. 55, No. 2, Feb. 2007.

John D. Kraus, The Helical Antenna, Proceedings of the I.R.E., Mar. 1948, March issue, I.R.E., New York.

* cited by examiner

101

102

200

301

302

303

304

401

402

701

702

703

704

801

RECONFIGURABLE AXIAL-MODE HELICAL ANTENNA

CROSS-REFERENCE TO RELATED APPLICATION

The present application claims priority to the following previously filed patent application, the contents of which are herein incorporated by reference:

U.S. Provisional Patent Application No. 61/267,792 filed Dec. 8, 2009 and entitled: RECONFIGURABLE AXIAL-MODE HELICAL ANTENNA.

FIELD OF THE INVENTION

The present invention relates generally to radio frequency antennas, and more particularly to axial-mode helical antennas which may be mechanically reconfigured such as to tune the antenna radiation pattern in use, for example.

BACKGROUND TO THE INVENTION

Helical antennas have widely been used for mobile and satellite radio applications since the 1950s [see Kraus reference listed below]. Compared to monopole antennas, helical antennas are preferred for their high gain and wideband impedance characteristics despite their compact form. In addition, helical antennas offer wideband circularly polarized (CP) radiation patterns and simple periodic structures. Helical antennas have different modes of operation. The helix is operating in the axial mode when the circumference in free space wavelength of the helix is about one wavelength. The principal lobe of the radiation pattern of an axial-mode helical antenna is extended along its axis [see Kraus reference listed below].

Several variations of the axial-mode helical antennas exist in the literature that focus on optimizing the length, pitch angle or radius of the helical antenna for a certain application. In one example [see Killen reference listed below], the pitch angle of an axial-mode helical antenna is varied in a non-linear manner from a relatively small angle at the feed to a large angle at the distal end of the antenna, to optimally match the phase velocity of the EM wave travelling through the antenna to that of the free space, and to provide multiple peak gains. In another example [see Chen reference listed below], exponential pitch spacing is recommended to increase the CP bandwidth of the antenna. In another example, a spring tunable helical whip antenna is built in [see Wilson reference listed below] for mounting in the frame of a vehicle. In addition, a Tri-band helical antenna to cover the EGSM/GPS/PCS bands is designed in another example [see Zhang reference listed below] that includes a dual-pitch axial-mode helical antenna. A variety of increasing cone, decreasing cone, and envelope helices are also introduced in further examples [see Kraus reference listed below]. However, little attention has been paid to dynamic optimization of the helix antenna parameters to match real-time application requirements.

On the other hand, emerging wireless communication devices call for antennas that can dynamically adjust one or multiple antenna characteristics such as the far-field radiation pattern, centre frequency or directivity, to new operating conditions. For example, such reconfigurable antennas can dynamically change their radiation pattern in order to improve the transmitted power efficiency and therefore conserve the battery of a hand-held device or dynamically steer nulls in the radiation pattern to mitigate unwanted interference and increase the signal-to-noise ratio (SNR) of a noisy link.

The adjustment of antenna characteristics can be realized through electrical, mechanical or other means. Solid-state switches such as PIN diodes [see Roscoe reference listed below] and RF-MEMS switches [see Kiriazi reference listed below] are among the most common methods used [see Bernhard book reference listed below]. However, these methods typically suffer from disadvantages such as non-linearity and low isolation and therefore may be undesirably limited in their potential throughput. In addition, only certain discrete changes can be attained using these methods.

Mechanical approaches to reconfigure the antennas are in general slow but may deliver the most dramatic antenna parameter changes [see Bernhard book reference listed below]. In addition, since the changes by mechanical approaches are applied to the physical antenna structure, reconfigurability schemes may be attained that may not be possible by other methods.

BRIEF SUMMARY OF THE INVENTION

According to an embodiment of the present invention, actuators based on smart materials such as shape memory alloys (SMAs) and/or electro-active polymers (EAPs) may be used to provide a dynamically reconfigurable axial-mode helical antenna.

According to another embodiment of the present invention, a reconfigurable axial-mode helical antenna is implemented using a shape memory alloy spring as an actuator. It is shown that by applying a DC current to the SMA spring, the length of the helical antenna and therefore its pitch spacing (the spacing between its turns) may be varied, such as may be desirable such as for varying frequencies of operation of the helical antenna for example. One advantage of SMA actuator is that they can provide a continuum of steps to change the length of the helix and therefore continuous variation and a smooth transition between different settings of helical antenna parameters (in this case, the radiation pattern).

The idea for using a helix as the reconfigurable antenna comes from the fact that unlike other antenna types, the spring-like helix structure is deformable by nature. Although the variation of the helix length may not tilt the beam in different directions, in another embodiment of the present invention an array of reconfigurable helices may be used to steer the main lobe in any of the planes.

Further embodiments of the present invention are detailed below, as well as description of the effects of reconfigurable helical antenna pitch spacing variations on the far-field radiation pattern of the antenna, which are revisited using FDTD numerical methods (CST). Variations of parameters such as gain and half-power beamwidth (HPBW) versus the pitch spacing are further described below for a regular and a conical decreasing cone. A further embodiment of the present invention is also provided in which experimental results of an exemplary reconfigurable helix antenna actuated by an SMA spring are described.

In one embodiment of the present invention, a reconfigurable helical antenna apparatus is provided, comprising:

a conductive antenna element formed in a substantially helical shape and comprising first and second ends and a plurality of turns;

an electrically controllable actuator element comprising first and second ends, wherein said first end of said actuator element is attached to said first end of said antenna element;

wherein said actuator element is operable to continuously vary a length of said antenna element by moving said first end of said antenna element relative to said second end of said antenna element in response to an electrical signal, and thereby to continuously vary a spacing between said turns of said antenna element.

BRIEF DESCRIPTION OF THE DRAWINGS

The present invention will now be described with reference to the accompanying drawing figures in which.

DETAILED DESCRIPTION OF SEVERAL EMBODIMENTS

II. The Reconfigurable Axial-Mode Helical Antenna

A. The Regular Reconfigurable Helical Antenna

According to several embodiments of the present invention reconfigurable axial-mode helical antennas are provided, in which the helical antenna is operating in the axial mode when the circumference in free space wavelength of the helix is about one wavelength, that is if $3/4<C\lambda<4/3$, the helix is operating in the axial mode [see Kraus reference listed below]. Assuming r is the free-space radius of the helix, $\lambda$ is the wavelength, S is the spacing between turns in the free space (pitch spacing), n is the number of turns, h is the total height (length) of the helix and $\alpha$ is the pitch angle, note that $h=n.S$ and $C\lambda=2\pi r/\lambda$. Also: $\tan(\alpha)=S/2\pi r$.

Analytical equations developed for the axial-mode helical antenna confirm a direct relationship between the pitch spacing and the directivity (and therefore gain) of the antenna [see Kraus reference listed below]:

$$D=12C_\lambda^2 nS_\lambda \tag{1}$$

where $S\lambda$ is the spacing between turns in free space wavelengths. In addition, the HPBW is predicted to have an inverse relationship with the root square of the helix pitch spacing [see Kraus reference listed below]:

$$HPBW = \frac{52^\circ}{C_\lambda\sqrt{nS_\lambda}} \tag{2}$$

However, these equations are restricted to pitch angles of $12^\circ \leqq \alpha \leqq 14^\circ$. Numerical experiments have been conducted in this section in order to investigate this trend on pitch angles beyond the specified limits. This helps to inspect the feasibility of reconfiguring the radiation pattern of a helix antenna by applying variations in the pitch angle (height), such as according to embodiments of the present invention.

The above-noted equations from Kraus are restricted to pitch angles of $12^\circ \leqq \alpha \leqq 14^\circ$ (see pp. 281-284 of Kraus reference listed below), although Kraus' original results indicate "optimal contours", based on axial ratio AR, impedance, and beam pattern, can be extended outside these pitch angles to about $5^\circ \leqq \alpha \leqq 35^\circ$. King and Wong [see King reference listed below] also built many helix antennas and developed further empirical equations for gain and HPBW over pitch angles 11.5° to 14.5°.

Numerical experiments may be used to investigate pitch angles well outside of Kraus' 12°-14° limits. This is motivated by the potential of reconfiguring the helix by varying in the pitch angle (height), with a constant length helical wire. Strictly speaking the radius of the helix may change in variation of the height, but this is typically small because the range of pitch angles is typically small.

Figure 1A:
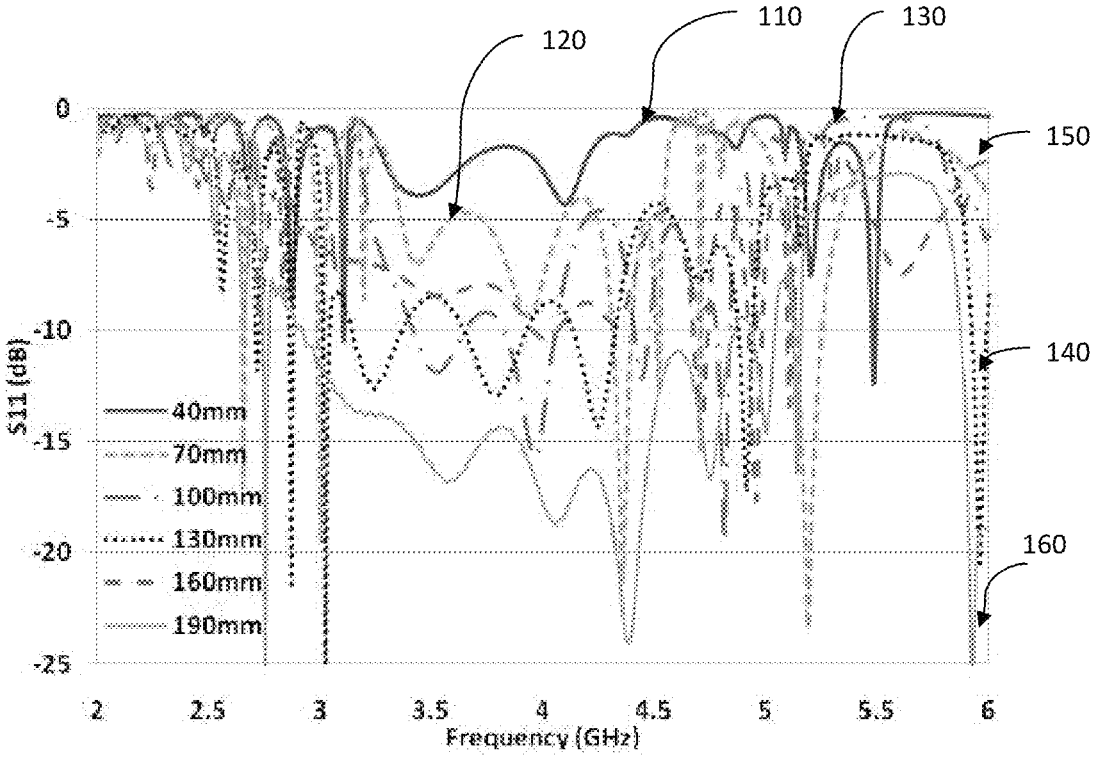
FIG. 1A illustrates a plot 101 showing Finite Integration Technique (FIT) simulated computations of the return loss (S11) of an exemplary tin-wire copper helix over a wide bandwidth, with the individual curves corresponding to the variations in antenna heights (pitch spacing) from 40 mm to 190 mm.
Figure 1B:
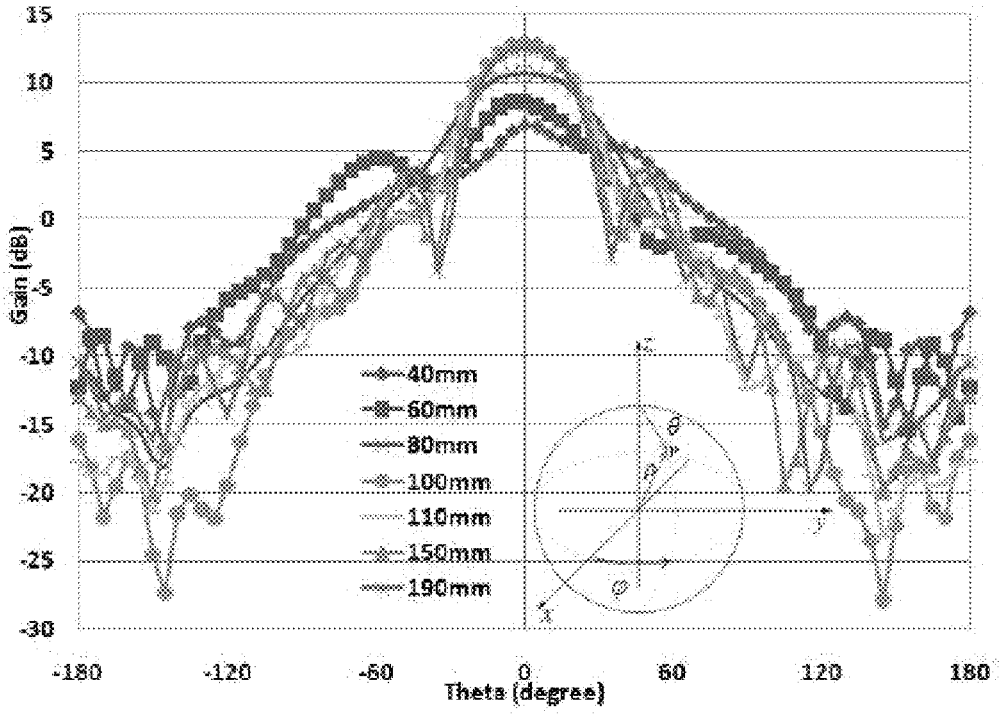
FIG. 1B illustrates a plot 102 showing FIT simulated computations of the variations in gain (dB) over a range of angles θ for a 4.35 GHz ($C_\lambda$=0.9)) far-field radiation pattern for the ϕ=0° plane of the an exemplary tin-wire copper helix referred in FIG. 1A, with the individual curves corresponding to the variations in antenna heights from 40 mm to 190 mm.

FIG. 1A illustrates a plot 101 showing Finite Integration Technique (FIT) simulated computations of the return loss (S11) of an exemplary tin-wire (0.7 mm diameter) copper helix with r=9.9 mm, n=11, and h varying from 35 to 195 mm (about $3^\circ \leqq \alpha \leqq 16^\circ$ over a wide bandwidth, with the individual curves 110-160 corresponding to the variations in antenna heights (pitch spacing) from 40 mm to 190 mm, respectively. Simulation under the FIT numerical methods maybe performed with any commercially simulation software, such as one available from Computer Simulation Technology (CST™), for example. A plastic hollow cylindrical base or core (dielectric constant=3.1, loss tangent=0.01) is used inside the helix, and has a radius of 7.5 mm. The mechanical base or core is implemented to provide mechanical stability to the helix element, and to reduce its bending as the height of the helix is varied. The effect of the actuator element (SMA spring) used to vary the height of the helix is also modeled by including another exemplary helical wire of radius $r_s$=0.31 mm, wire thickness of $d_s$=0.075 mm, number of turns=3 turn/mm and Nitinol conductivity of 106 S/m inside the plastic tube core element, and with the same height as the helical antenna element. A ground plane element at the base of the antenna is provided as an exemplary 200×200 $mm^2$ square copper ground plane. FIG. 1B illustrates a plot 102 showing FIT simulated computations of the variations in gain (dB) over a range of angles $\theta$ for a 4.35 GHz ($C_\lambda$=0.9)) far-field radiation pattern for the $\phi=0^\circ$ plane of the an exemplary tin-wire copper helix referred in FIG. 1A, with the individual curves corresponding to the variations in antenna heights from 40 mm to 190 mm.

As shown in FIG. 1A, a reasonable matching is observed for heights of about 70 mm or more over a wide bandwidth substantially centered around about 4.35 GHz. As expected from the empirical equations, the axial mode pattern of the helix antenna generally becomes more directive as the antenna pitch spacing (height) of the antenna corresponding to curves 110-160 increases, i.e., the maximum gain/directivity increases and the HPBW decreases as the height of the antenna increases. It is evident from FIGS. 1A and 1B that the axial mode propagation pattern can be changed by varying the height and thereby the pitch spacing of the helical antenna while maintaining substantially the same operating frequency.

Figure 2:
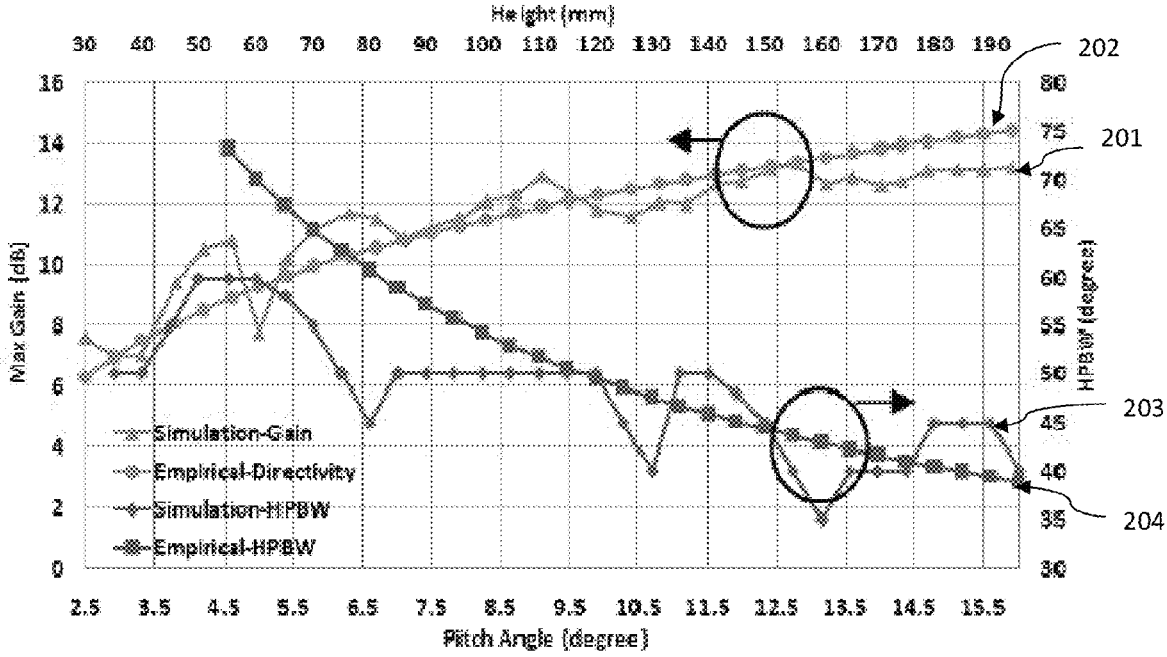
FIG. 2 illustrates a plot 200 showing curves 201 and 202 corresponding to the respective FIT simulated maximum gain and empirical computations of the directivity of an axial-mode helix antenna versus antenna height (pitch angle), and curves 203 and 204 corresponding to the respective FIT simulated and empirical formula computations of the Half-Power Beamwidth (HPBW) of the same axial-mode helix antenna versus antenna height (pitch angle).

FIG. 2 illustrates a plot 200 showing curves 201 and 202 corresponding to the respective FIT simulated maximum gain and empirical computations of the directivity of an exemplary axial-mode helix antenna versus antenna height (pitch angle), and curves 203 and 204 corresponding to the respective FIT simulated and empirical formula computations of the Half-Power Beamwidth (HPBW) of the same axial-mode helix antenna versus antenna height (pitch angle). To further inspect variations of the helix antenna parameters outside of the pitch spacing range specified and discussed in the Kraus reference listed below, the maximum gain and HPBW for an exemplary helical antenna were determined numerically and results of such numerical modeling are presented in FIG. 2 in curves 201 and 203 respectively. The empirical curves 201 and 204 for the respective maximum gain and HPBW parameters are also presented in FIG. 2 for comparison. The directivity curve 201 for the exemplary helical antenna was determined to substantially follow the mean form of the numerical experiments. The oscillating form of the experiments may be expected from surface radiation principles (such as may be developed following the Kraus analysis). Consequently, the directivity formula may not be expected to be highly accurate for a given structure (with a given surface wave velocity) but the directivity formula may still be used as an excellent rule of thumb for the mean gain (over different pitch angles or surface wave velocities) of a copper helix such as an exemplary copper helical antenna element. The HPBW curve 203 for such a helical antenna was found to hold close for substantially larger pitch angles, but not for substantially smaller pitch angles. Both simulated gain and HPBW results as shown in curves and 201 and 203 confirm that different pitch spacings (or height of the helical antenna for a helical antenna of fixed wire length) of an axial mode helical antenna element will give different gains. Therefore, a novel dynamically reconfigurable axial mode helical antenna according to an embodiment of the present invention, such as may provide for reconfiguration over a pitch angle range between about 2° to 16° may desirably provide advantages in controlling and adjusting antenna propagation properties such as for adapting to varying propagation requirements in use. For example, FIGS. 1A, 1B, and 2 show a gain variation between about 7 to 13 dB, when the height of an exemplary helical antenna is varied between about 40 to 110 mm. An associated HPBW of between about 60° to 45° can be attained if the height of the helical antenna is varied between about 55 and 80 mm.

It should be noted that while the relations predicted by the conventional equations generally hold, exceptions are observed at some antenna heights, for example, the maximum gain is increased with increasing the pitch spacing of the antenna for most points from about 50 up to 70 mm (such as may compare to about one wavelength height at an exemplary frequency of operation of about 4 GHz), but an abrupt decrease is observed at 70-80 mm (these pitch spacings may also be characterized in terms of wavelength). Study of the pattern reveals that pattern side lobes are increased in these cases. In addition, the HPBW may be increased by increasing the height of the helical antenna element from about 50 to 55 mm and from about 80 to 85 mm, but may be decreased by increasing the height of the helix otherwise.

B. The Conical Reconfigurable Helical Antenna

The conical axial-mode helical antenna can be used as a reconfigurable helical antenna in a similar manner as the regular helical antenna, according to another embodiment. The conical helix offers the axial mode over a much wider band with more directive pattern and smaller sidelobes [see Chatterjee reference listed below].

From the reconfigurable system point of view, the increasing axial-mode helix offers the additional advantage of mechanical stability when its height is varied by virtue of its conical shape. Therefore, no plastic base or core may be required in the case of a conical helix antenna element in order for the reconfigurable antenna to have sufficient mechanical stability for use.

Figure 3A:
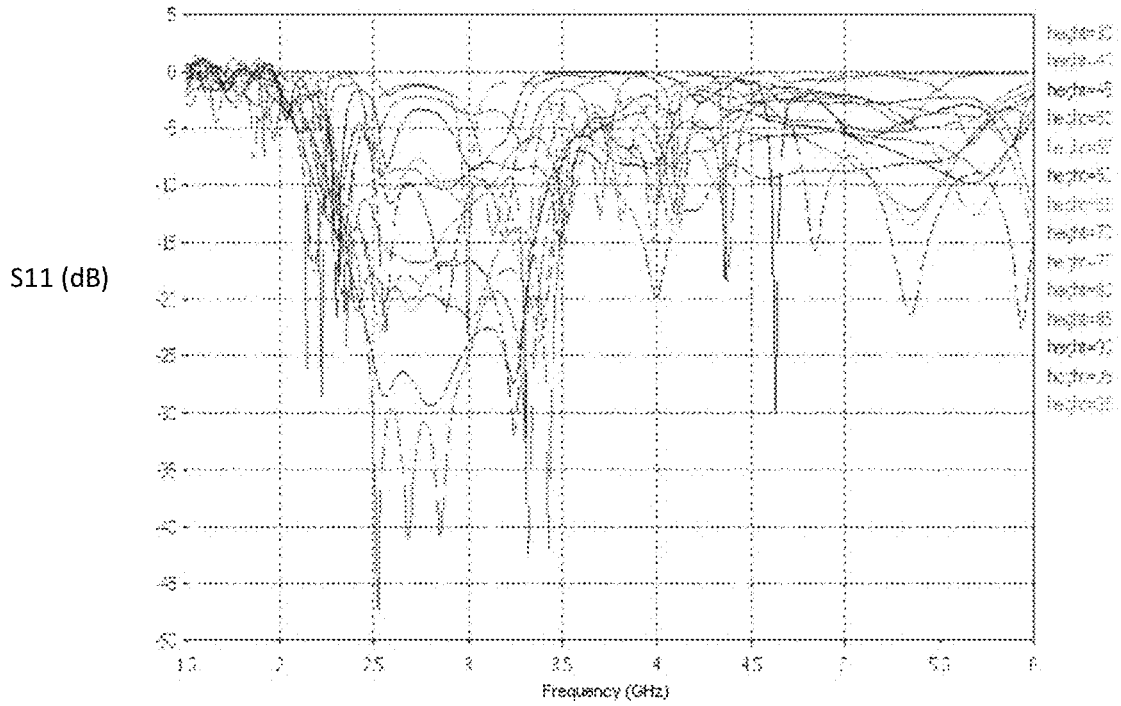
FIG. 3A illustrates a plot 301 showing Finite-Difference Time-Domain (FDTD) simulation results for the input return loss (S11) of a conical helix antenna over a wide bandwidth according to an embodiment of the invention with a maximum radius of 18 mm and a radius ratio of 0.55, with the individual curves corresponding to the variations in antenna heights from 30 mm to 95 mm.
Figure 3B:
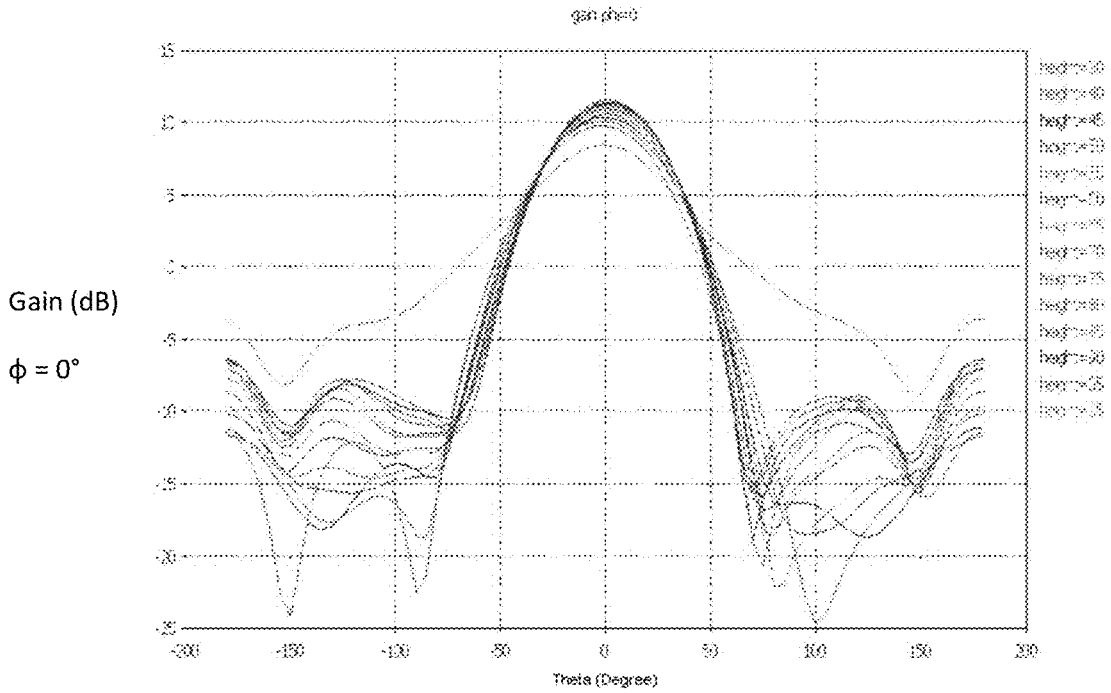
FIG. 3B illustrates a plot 302 showing FDTD simulation results of the variation in gain (dB) over a range of angles θ for a 3 GHz far-field radiation pattern for the ϕ=0° plane of the conical helix antenna according to the embodiment of FIG. 3A, with the individual curves corresponding to the variations in antenna heights from 30 mm to 95 mm.
Figure 3C:
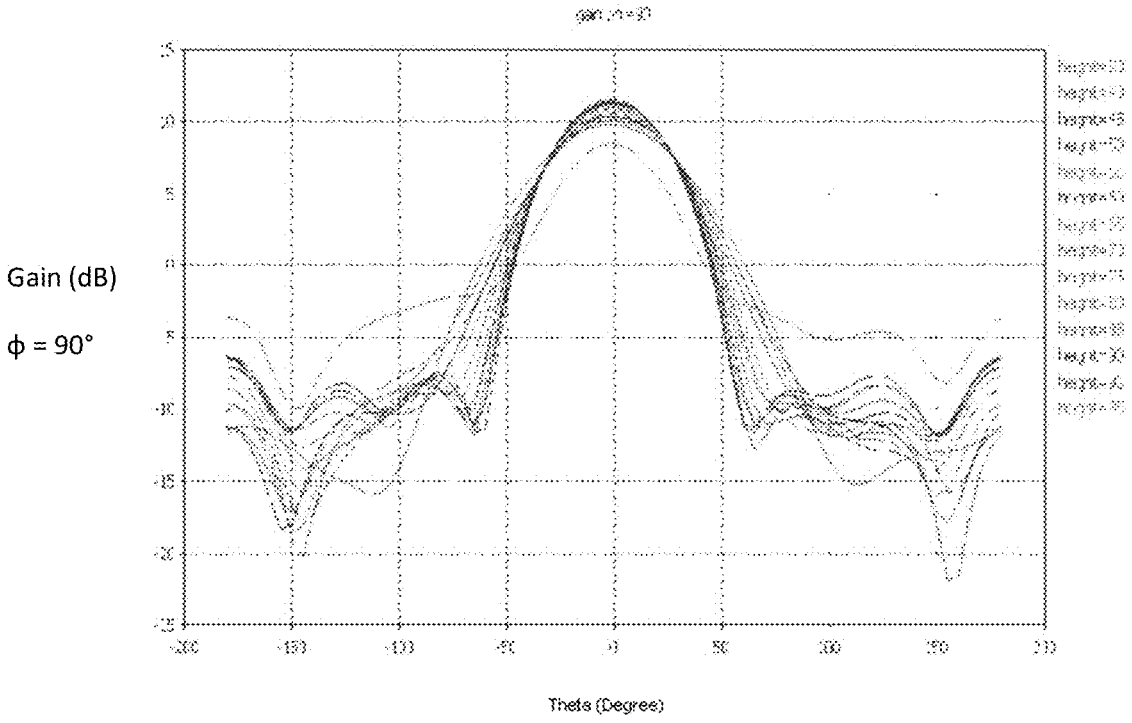
FIG. 3C illustrates a plot 303 showing FDTD simulation results of the variations in gain (dB) over a range of angles θ for a 3 GHz far-field radiation patterns for the ϕ=90° plane of the conical helix antenna according to the embodiment of FIG. 3A, with the individual curves corresponding to the variations in antenna heights from 30 mm to 95 mm.
Figure 3D:
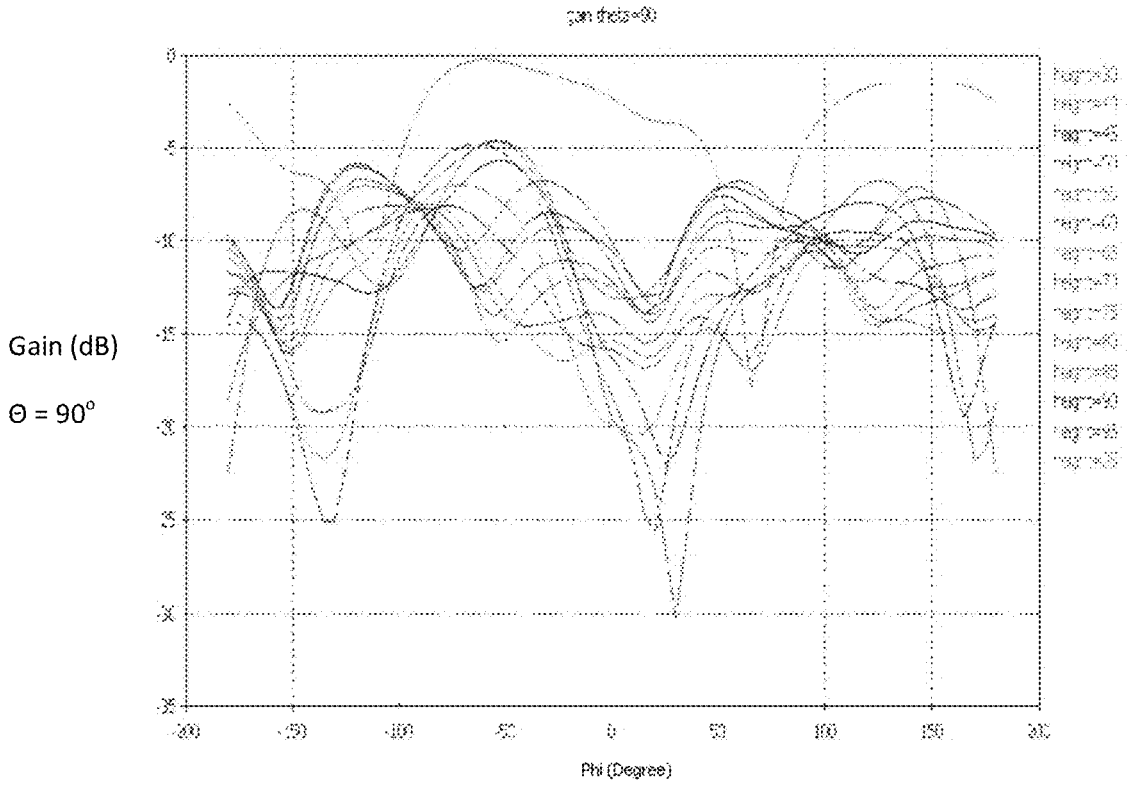
FIG. 3D illustrates a plot 304 showing FDTD simulation results of the variations in gain (dB) over a range of angles ϕ for a 3 GHz far-field radiation patterns for the θ=90° plane of the conical helix antenna according to the embodiment of FIG. 3A, with the individual curves corresponding to the variations in antenna heights from 30 mm to 95 mm.
Figure 4A:
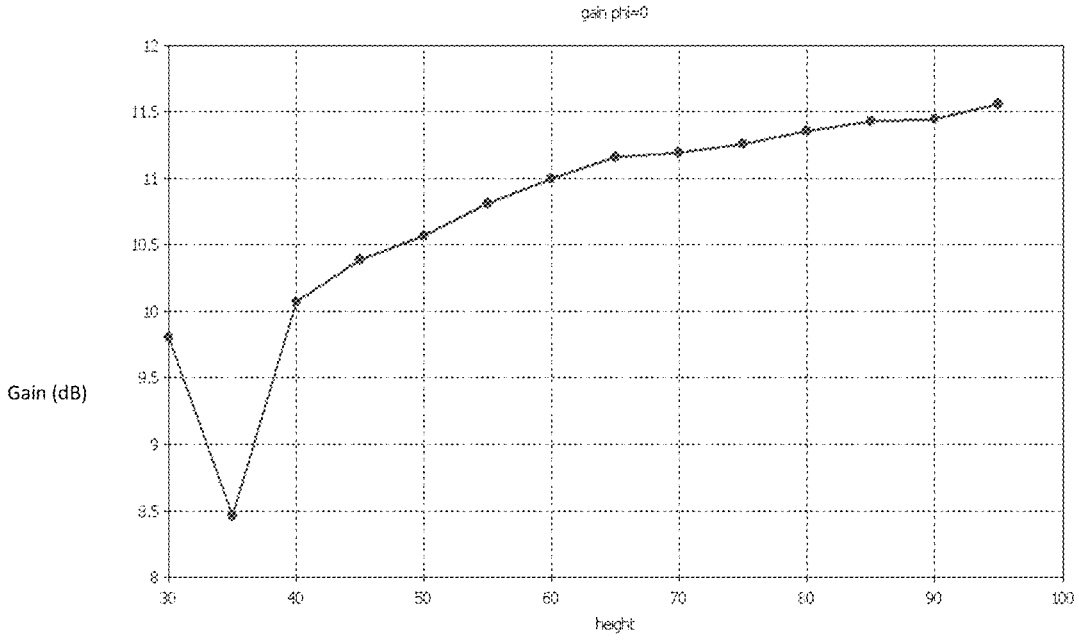
FIG. 4A illustrates a plot 401 showing FDTD simulation results of the maximum gain (dB) over a range of antenna heights (mm) for a 3 GHz far-field radiation pattern for the ϕ=0° plane of the conical helix antenna according to the embodiment of FIG. 3A.
Figure 4B:
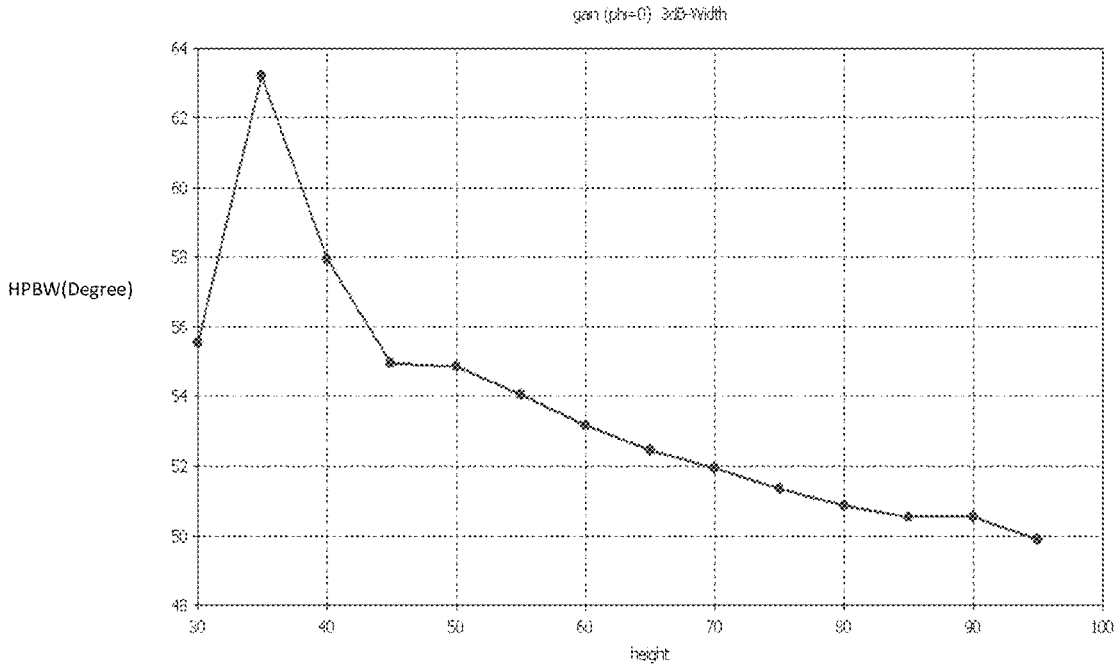
FIG. 4B illustrates a plot 401 showing FDTD simulation results of the HPBW (degrees) over a range of antenna heights (mm) for a 3 GHz far-field radiation pattern for the ϕ=0° plane of the conical helix antenna according to the embodiment of FIG. 3A.

FIG. 3A illustrates a plot 301 showing Finite-Difference Time-Domain (FDTD) simulation results for the input return loss (S11) of a conical helix antenna over a wide bandwidth according to an embodiment of the invention with a maximum radius of 18 mm and a radius ratio of 0.55, with the individual curves corresponding to the variations in antenna heights from 30 mm to 95 mm. The helix has 6 turns and its height is varied between 30 to 95 mm. It can be seen that a good matching can be attained for a wideband around 3 GHz. The far-field radiation patterns of the conical helix antenna at 3 GHz are shown in FIGS. 3B-3D. More specifically, FIG. 3B illustrates a plot 302 showing FDTD simulation results of the variation in gain (dB) over a range of angles θ for a 3 GHz far-field radiation pattern for the $\phi=0°$ plane of the conical helix antenna according to the embodiment of FIG. 3A, with the individual curves corresponding to the variations in antenna heights from 30 mm to 95 mm. FIG. 3C illustrates a plot 303 showing FDTD simulation results of the variations in gain (dB) over a range of angles θ for a 3 GHz far-field radiation patterns for the $\phi=90°$ plane of the conical helix antenna according to the embodiment of FIG. 3A, with the individual curves corresponding to the variations in antenna heights from 30 mm to 95 mm. FIG. 3D illustrates a plot 304 showing FDTD simulation results of the variations in gain (dB) over a range of angles ϕ for a 3 GHz far-field radiation patterns for the $\theta=90°$ plane of the conical helix antenna according to the embodiment of FIG. 3A, with the individual curves corresponding to the variations in antenna heights from 30 mm to 95 mm. As can be seen in FIGS. 3A-D, by varying the height of the helix from 40 to 95 mm, the maximum gain can be tuned from 10 to 11.5 dB in continuous steps. Also the HPBW can be tuned from 63 down to 50°. Note that the discrepancies with the Kraus equations (equations (1-2)) are again observed in the 35 mm height. These results are shown also in FIGS. 4A and 4B which illustrate respective plots 401 and 402 showing FDTD simulation results of the respective maximum gain and HPBW over a range of antenna heights (mm) for a 3 GHz far-field radiation pattern for the $\phi=0°$ plane of the conical helix antenna according to the embodiment of FIG. 3A.

C. The Axial-Mode Dual-Helix Array

In many applications, it is desired to reconfigure the radiation pattern of an antenna by directing the main lobe of the radiation pattern to the sides, i.e. towards directions at various angles relative to the primary axial direction. Such a structure may be implemented according to one embodiment of the invention using an array of two or more individual deformable helical antenna elements as are individually discussed above in Subsections. A and B. The number of these individual helices or helical antenna elements, the height and/or length of each individual helix, as well as their individual configuration and placement versus each other can be desirably optimized to attain a desired configuration such as to produce a desired radiation pattern. In certain such multi-helix embodiments, one or more of the helical antenna elements may desirably be coupled to an actuator element to allow for reconfiguration of the helical antenna element, such as by changing its length and thereby the pitch angle of the turns of the antenna element, to provide for continuously variable reconfigurability of the helical antenna element(s). In a particular embodiment, each of the helical antenna elements in a multi-helix array may be individually reconfigurable so as to provide for optimal versatility in the dynamic reconfiguration of the antenna array, such as may be applicable for varying the shape of the radiation pattern of the multi-helix antenna array to direct its main lobe at an angle (i.e. to the sides of the radiation pattern) relative to the axial direction of the individual helices.

As an example, in one embodiment, reconfigurable helical antennas may comprise antenna structures which include a plastic cylindrical base or core such as to provide mechanical support to the helical antenna elements. These helical antennas may be fed through a single feed point. The relative location of the feed point may be considered as a design parameter for optimal matching of the multi-helix antenna array.

In an exemplary multi-helix embodiment, the axial-mode antenna array may include two helical antenna elements, counterwound, with one helix wound right handed with a first height, and a second helix wound left handed with a second height. In one such embodiment, the two helical antenna elements may also have substantially the same radius and length. Each helical antenna element may preferably be coupled with an actuator element, such that the first and second heights of the antenna elements, and therefore also their pitch angles, may be independently and continuously variably controlled by movement of the individual actuator elements. In a particular such embodiment, the two helical antenna elements may be fed axially from a single fixed corporate feedline, with the two helical antenna elements spaced equally from the common feed point. The separation of the helical antenna elements and the location of the common feed point may be configured so as to provide a desired changing antenna array radiation pattern, such as to span different polarizations and gain directions, for example, as may be required for a particular application. Through the use of actuator elements to allow for individual continuously variable configuration (through change of height) of each helical antenna element, the overall radiation pattern of the dual-helix array may be desirably continuously varied is use, such as to provide a dynamically controllable radiation pattern which may be configured to provide for particular applications such as to provide a substantially orthogonal pattern as may be useful in diversity/MIMO applications, or to provide for "squinting" of the radiation pattern to direct its main lobe at an angle (i.e. to the sides of the radiation pattern) relative to the axial direction of the individual helical antenna elements, for example.

III. Experimental Results

A. Shape Memory Alloys (SMAs)

Shape memory alloys (SMAs) are materials that can restore their original configuration by heating after they are plastically deformed at low temperature. In other words, they seem to "remember" their original shape. The most common shape memory alloy is Nitinol: an alloy of nickel and titanium. The temperature variation can be realized by passing a DC current through the SMA, for example in Nickel-Titanium alloys. Some examples of these actuators can elongate by up to 250% for example. Quick cooling can provide millisecond return to the actuator's original shape. Typically, SMAs contract at high temperature and a tensile stress is required to return them to their original elongated state following cooling.

Previous applications of the SMA actuators for antennas include contour optimization of large space reflector antennas [see Song reference listed below] and deployable space antennas and structures [see Mandavi reference listed below].

Some of the disadvantages of SMA materials include their potential sensitivity to ambient temperature, their low efficiency (<5%), and their non-linear characteristics such as hysteresis properties [see Jayender reference listed below]. Hysteresis problems can be resolved by use of feedback and other control systems. It should be noted that SMAs should be isolated from the ambient temperature if dramatic changes are expected due to their sensitivity to heat.

In one embodiment of the present invention, SMA spring actuators may be used to vary the length of a reconfigurable helical antenna. The reconfigurable helical antenna system using an SMA spring actuator according to such an embodiment is explained in the following subsection. In other embodiments, other types of actuator means may be implemented such as to dynamically vary the length of a reconfigurable helical antenna.

B. In an exemplary reconfigurable helical antenna system 510 according to one embodiment of the invention, a reconfigurable axial-mode helical antenna 510 is shown in the perspective view of FIG. 5. The exemplary system optimally comprises an 11-turn axial-mode helical antenna 540.

Figure 5A:
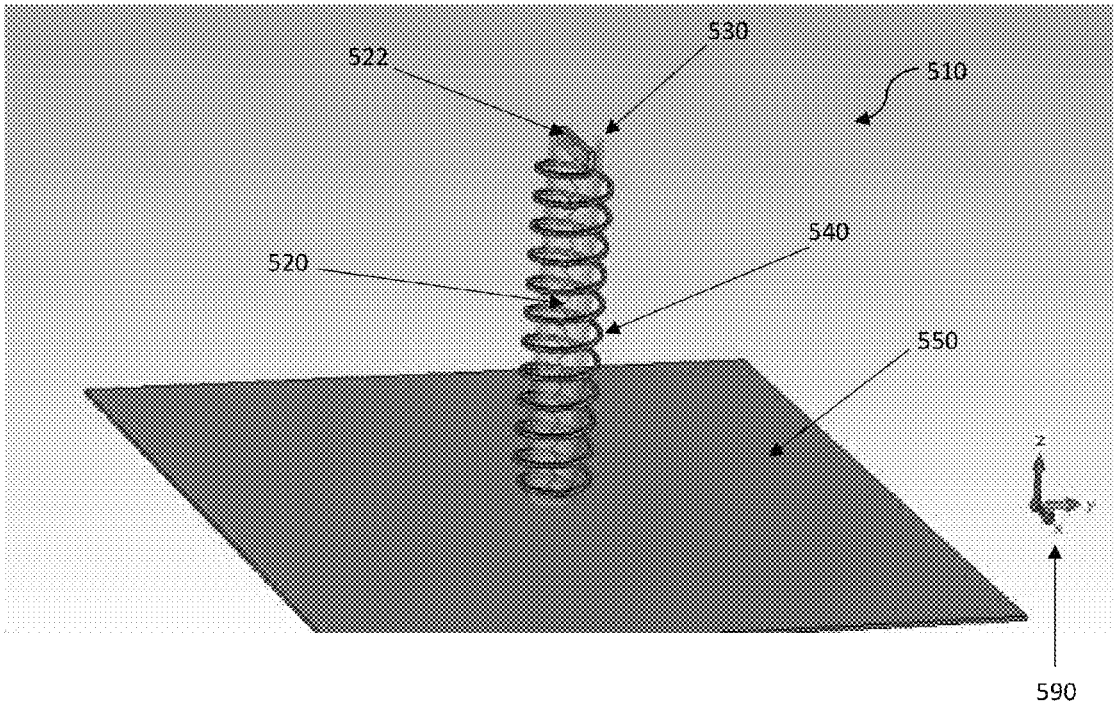
FIG. 5*a* is a perspective view of an embodiment of the helical antenna assembly with a transparent core for diagrammatic clarity according to the invention.

The helical antenna may optimally have a radius of 9.9 mm and the wire thickness of 0.7 mm and be made of copper wire, although other dimensions and materials may be employed. The antenna 540 is optimally wound or turned loosely around a cylindrical hollow plastic base or core 530 and may be fixed or attached on a feed located on a ground plane 550 with the bottom of the antenna 540 abutting the ground plane 550. A second end or top of the antenna 540 is located distally to the ground plane 550. The optimal position of the elongated core 530 is to be vertically mounted substantially perpendicular to the ground plane 550 such that the longitudinal axis of the core 530 is generally coplanar with the z or vertical plane as shown in FIG. 5 with reference to the axes indicator 590. The ground plane 550 may optimally be comprised of a 200×200 mm2 copper sheet, for example. In one embodiment, the plastic base or core 530 is operable to resist bending of the helical antenna 540 when its height is altered. In other embodiments, the core 530 or plastic base may be formed of other materials such as extruded polystyrene foam (i.e. Styrofoam®) for ease of cutting and its robustness. A series of two elongate spring actuators 520 (such as exemplary BMX-150 Biometal® Springs) are disposed along the central, longitudinal axis of the core 530. The spring actuators 520 may be SMA spring actuators, or may be comprised of other suitable materials or means. One end of the spring actuators 520 is connected to the upper end or top of the helical antenna 540 by a horizontal plastic rod or tab 522 which is mounted substantially perpendicular to the spring actuators 520, and the other end of the spring actuators 520 are located distally to the ground plane 550. The distal end of the core 530 comprises two longitudinal slots 524 disposed on two sides of the core 530 and located in the same vertical or z plane. The tab 522 is slideably retained in the slots 524 which are adapted to receive the tab 522. The bottom end of the spring actuators 520 may be fixed under the ground plane 550. In a further embodiment, the helical antenna 540 may also act as a reverse force spring for the SMA spring actuators (or springs) 520 to expand them when no deforming current is applied. In such an embodiment, when sufficient DC current is applied to the SMA springs 520, they start shrinking and applying a downward force to the horizontal rod or tab 522, which in turn distributes a downward force on the helical antenna 540, thereby decreasing the length and the spacing between turns (Sλ) of the helical antenna 540. In operation, when the current is turned off, the antenna 540 extends and assists the SMA springs 520 to return to the extended position also. The two narrow slots 524 at the two sides of the plastic tube 530 provide spacing for the horizontal rod to move downward, as shown in FIG. 5. The spring actuator 520 and the antenna 540 may be electrically isolated.

Figure 5B:
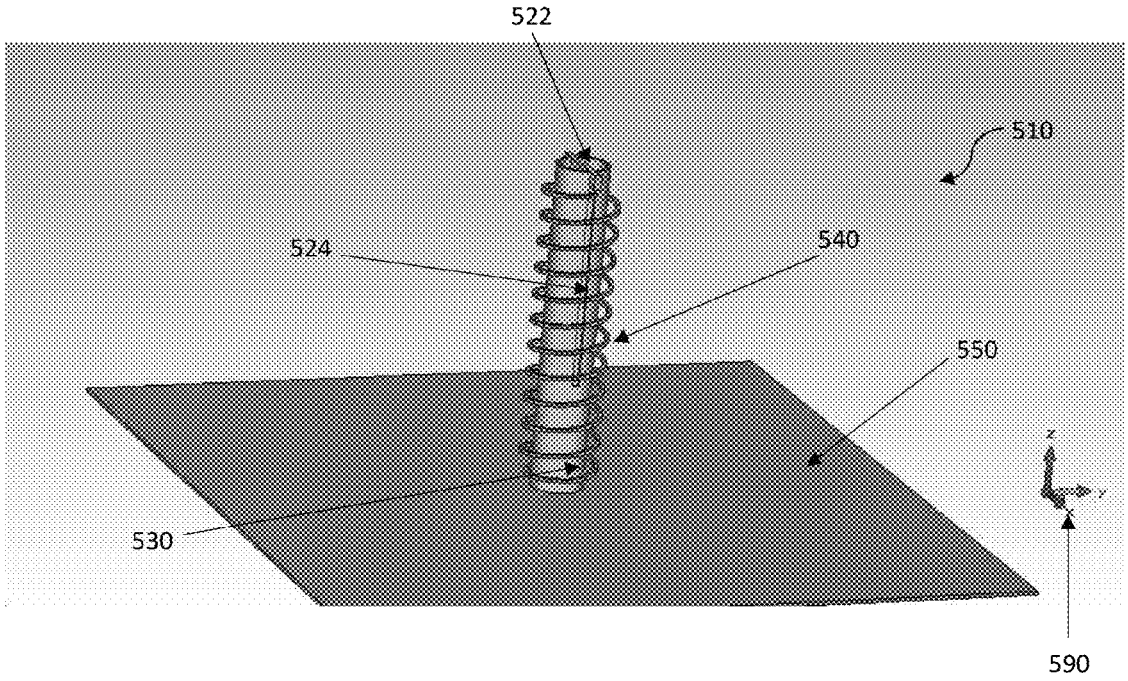
FIG. 5*b* is a perspective view of an embodiment of the helical antenna assembly with an opaque core as in operation according to the invention.

Now referring to FIG. 5*b*, a perspective view of the antenna assembly 510 is shown wherein the core or plastic tube 530 is opaque as may typically be in practice where the core 530 is comprised of a substantially opaque material. The bottom end of the core 530 is shown mounted on the ground plane 550, with the core 530 extending vertically to a distal end housing a horizontally mounted tab 522 attached to both the distal end of the antenna 540 which is wound around the core 530 in a spiral fashion to form a helix. The tab 522 is optimally a rectangular prism disposed horizontally and seated in two slots which are disposed in the upper portion of the core 530 and adapted to receive the tab 522. A spring actuator or optimally a pair of spring actuators 520 (not shown here) are disposed longitudinally downward from the center point of the tab 522, although other configurations may be employed.

In operation, an electrical current, optimally DC, is applied to the spring actuators 522, which shorten, thereby drawing the tab 522 down towards the ground plane 550 along the slots 524 and in turn compressing the antenna 540 which is attached to the tab 522 to the desired height and pitch spacing. When the current is removed, the tab 522 travels back up the slots 524 towards the distal end, returning the antenna 540 to the standard position.

Figure 6:
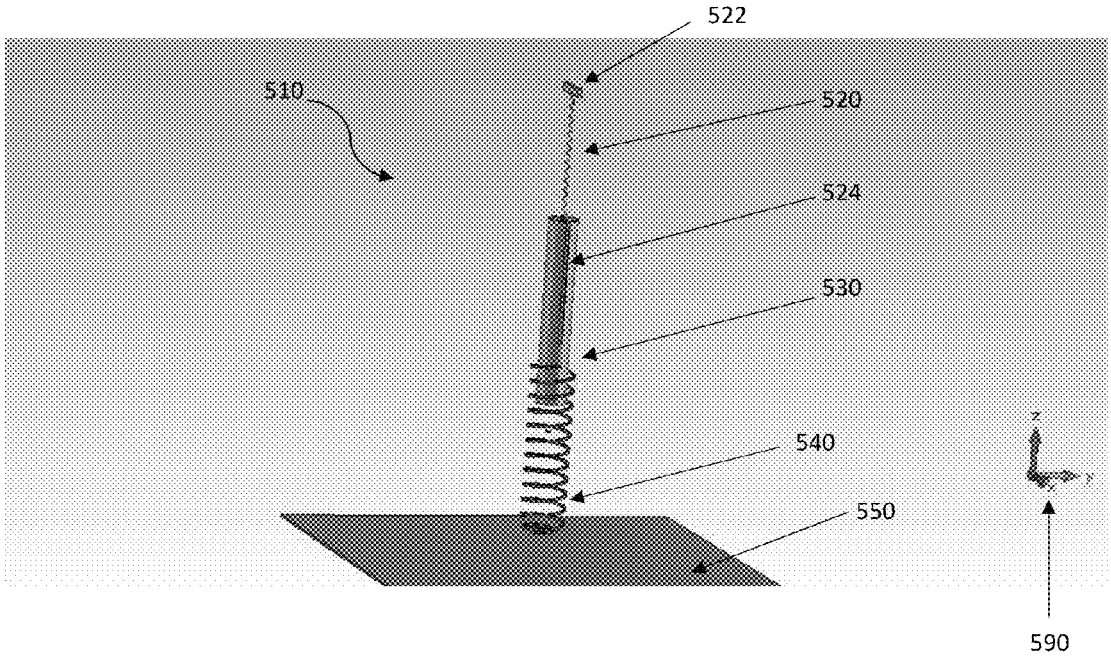
FIG. 6 is an exploded perspective view of an embodiment of the helical antenna assembly for diagrammatic clarity according to the invention.

FIG. 6 shows an exploded perspective view of the antenna assembly 510, with the spring actuator 520 disposed coaxially and internally to the core 530, with the antenna 540 disposed in a helix coaxial to both the core 530 and spring actuator 520, and with these three components being disposed perpendicularly to a ground plane 550. The spring actuator 520 has a tab 522 mounted horizontally at its top end. The core 530 has two longitudinal slots 524 disposed in the same plane substantially through the upper and middle portions of the core 530. In operation, variations of the helical antenna 540 length are determined by the applied DC current to the spring actuator 520 which is optimally an SMA, according to a further embodiment. One exemplary suitable such SMA spring actuator 520 may desirably show very little hysteresis effect and may consume a maximum DC current of about 150 mA (450 mW) for full actuation, which is equivalent to shrinking by about 4 cm (sheet resistance of about 400 Ω/m). In one embodiment, the length variation steps to which the length of the helical antenna element may be adjusted or reconfigured may be desirably be substantially continuous, thereby creating substantially smooth transitions between various antenna pattern configurations. The original, extended length of the SMA(s) 520 (and helical antenna element 540) is about 8 cm in a particular embodiment. Return loss and pattern simulation and measurement results for different lengths of the helical antenna 540 are described in the following section.

C. Measurement Results

Figure 7A:
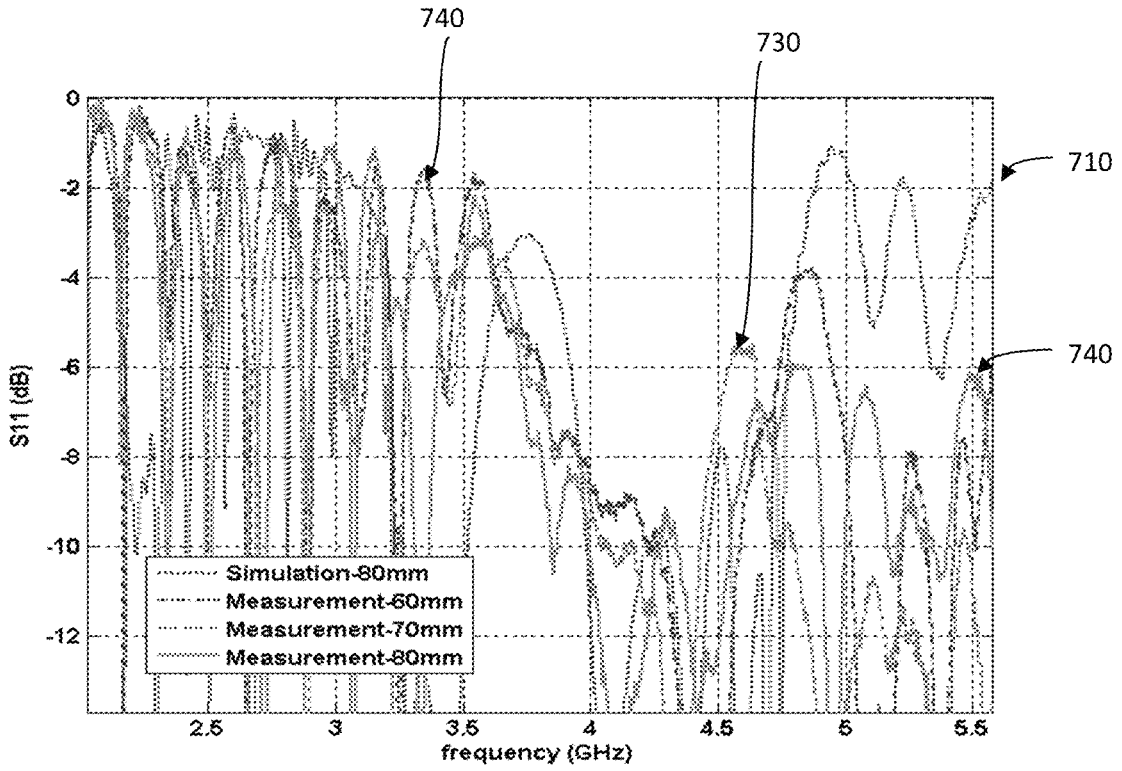
FIG. 7A illustrates a plot 701 showing comparisons in return loss (S11) (db) over a wide bandwidth (Hz) among simulated results (curve 710) and measured results at an antenna height of 60 mm, 70 mm, 80 mm (curves 720, 730, and 740 respectively) for a reconfigurable helix antenna according to an embodiment of the invention.

According to an embodiment of the present invention, a complete reconfigurable helical system may be implemented as explained in the previous subsection and may be measured using a 5071 Agilent VNA for return loss (S11) measurements and a Satimo StarLab anechoic chamber for pattern measurements, for example. FIG. 7A illustrates a plot 701 showing comparisons in return loss (S11) (db) over a wide bandwidth (Hz) among simulated results (curve 710) and measured results at an antenna height of 60 mm, 70 mm, 80 mm (curves 720, 730, and 740 respectively) for a reconfigurable helix antenna according to an embodiment of the invention. It can be seen that good impedance matching is attained around 4 GHz for all sweep points (not all sweep points are shown), as also expected from the simulation results. A good correlation is seen around the target 4 GHz after simulations are modified to model the plastic base and the SMA spring. However, some discrepancies can be seen in the band between the simulation shown in curve 710 and the measurement results shown in curves 720, 730, and 740. These discrepancies may be due to various reasons such as uneven pitch spacing in the practically contracted helix structure, for example. A better designed mechanical structure using a more elastic wire for the antenna according to a further embodiment can improve the uniformity of pitch spacing. In addition, a second spring can be used for the antenna structure, with the antenna wound around its turns, to provide a more robust deformable structure according to a further embodiment.

Figure 7B:
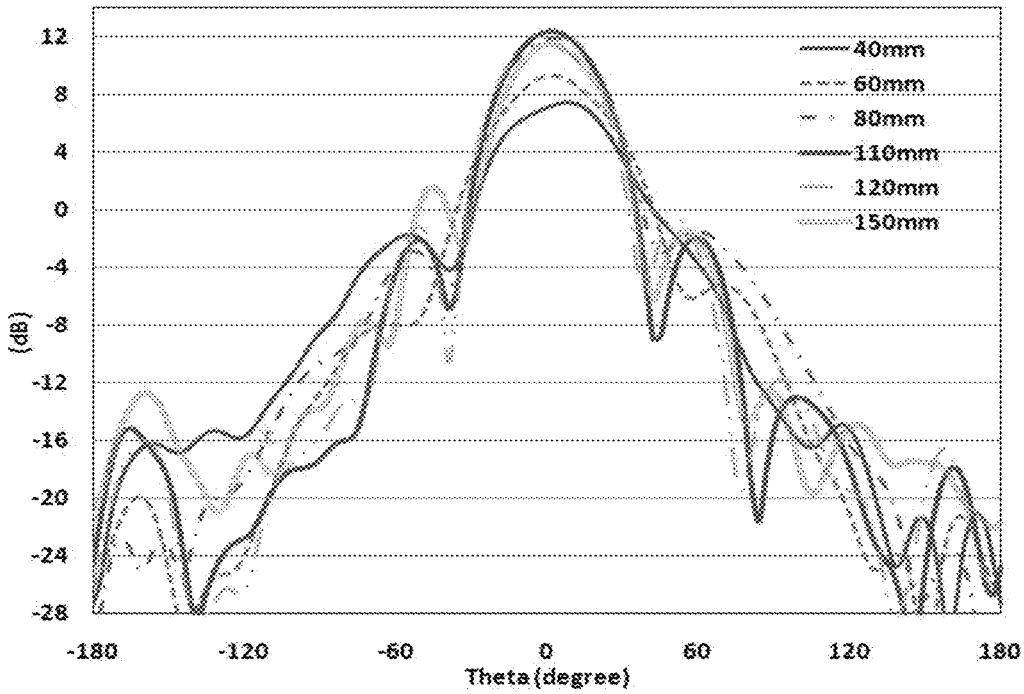
FIG. 7B illustrates a plot 702 showing measurement/experimental results of the of the variations in gain (dB) over a range of angles θ for a 4.35 GHz ($C_\lambda$=0.9)) far-field radiation pattern for the ϕ=0° plane of a reconfigurable helix antenna according to an embodiment of the invention, with the individual curves corresponding to selected variations in antenna heights from 40 mm to 150 mm.
Figure 7C:
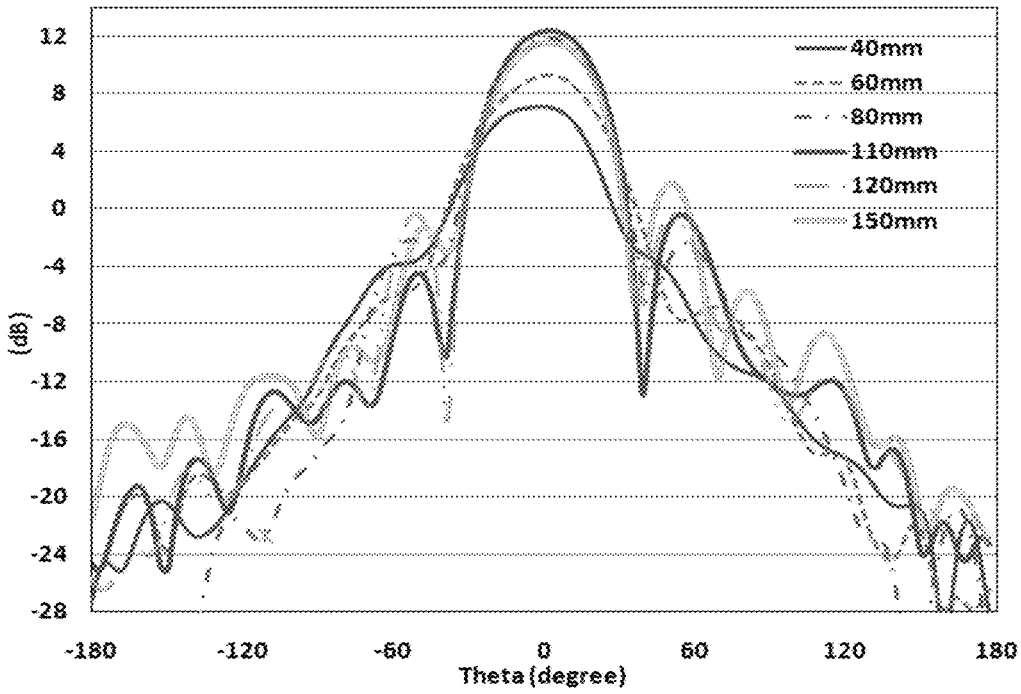
FIG. 7C illustrates a plot 703 showing measurement/experimental results of the of the variations in gain (dB) over a range of angles θ for a 4.35 GHz ($C_\lambda$=0.9)) far-field radiation pattern for the ϕ=90° plane of a reconfigurable helix antenna according to an embodiment of the invention, with the individual curves corresponding to selected variations in antenna heights from 40 mm to 150 mm.
Figure 7D:
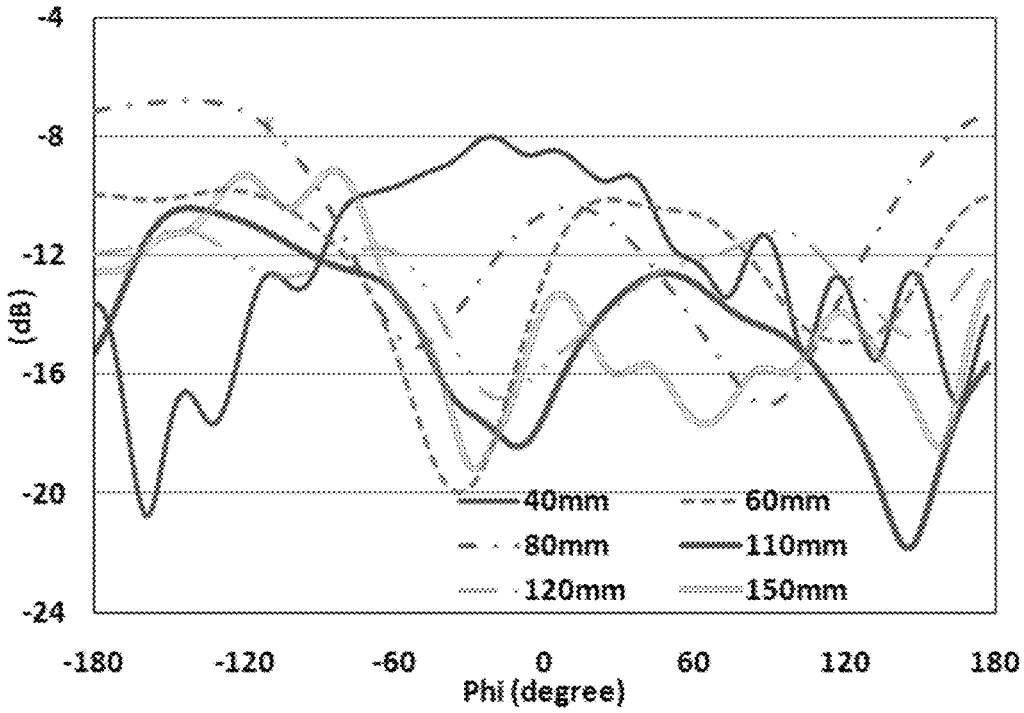
FIG. 7D illustrates a plot 704 showing measurement/experimental results of the variations in gain (dB) over a range of angles θ for a 4.35 GHz ($C_\lambda$=0.9)) far-field radiation pattern for the θ=90° plane of a reconfigurable helix antenna according to an embodiment of the invention, with the individual curves corresponding to selected variations in antenna heights from 40 mm to 150 mm.

FIG. 7B illustrates a plot 702 showing measurement/experimental results of the of the variations in gain (dB) over a range of angles θ for a 4.35 GHz ($C_\lambda$=0.9)) far-field radiation pattern for the ϕ=0° plane of a reconfigurable helix antenna according to an embodiment of the invention, with the individual curves corresponding to selected variations in antenna heights from 40 mm to 150 mm. FIG. 7C illustrates a plot 703 showing measurement/experimental results of the of the variations in gain (dB) over a range of angles θ for a 4.35 GHz ($C_\lambda$=0.9)) far-field radiation pattern for the ϕ=90° plane of a reconfigurable helix antenna according to an embodiment of the invention, with the individual curves corresponding to selected variations in antenna heights from 40 mm to 150 mm. FIG. 7D illustrates a plot 704 showing measurement/experimental results of the variations in gain (dB) over a range of angles θ for a 4.35 GHz ($C_\lambda$=0.9)) far-field radiation pattern for the θ=90° plane of a reconfigurable helix antenna according to an embodiment of the invention, with the individual curves corresponding to selected variations in antenna heights from 40 mm to 150 mm. As expected from simulation results, a variety of pattern configurations are attained. However, as also discussed for the simulation results, the pattern reconfigurability trend does not necessarily follow the Kraus equations. This is depicted in more detail in FIG. 8, as described below.

Figure 8:
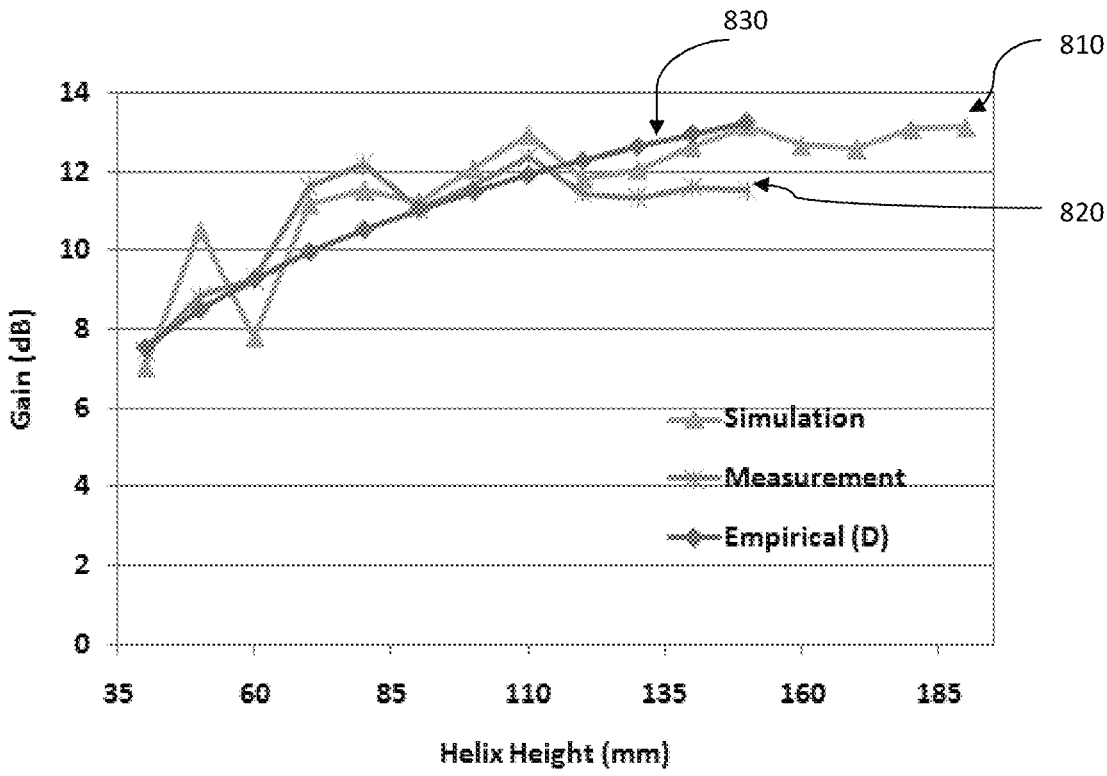
FIG. 8 illustrates a plot 801 showing comparisons among the simulated maximum gain (curve 810), measured maximum gain (dB) (curve 820), and empirical directivity (curve 830) over a selected range of antenna heights from 35-185 mm for a 4.35 GHz ($C_\lambda$=0.9)) far-field radiation pattern for the ϕ=0° plane of a reconfigurable helix antenna according to an embodiment of the invention.

FIG. 8 illustrates a plot 801 showing comparisons among the simulated maximum gain (curve 810), measured maximum gain (dB) (curve 820), and empirical directivity (curve 830) over a selected range of antenna heights from 35-185 mm for a 4.35 GHz ($C_\lambda$=0.9)) far-field radiation pattern for the ϕ=0° plane of a reconfigurable helix antenna according to an embodiment of the invention. As can be seen from FIG. 8, the maximum gain of the helix can be tuned from 7.4 to 12.36 dB according to one embodiment of the present invention. However, this trend may not be increasing with the displacement at all points, for example, the gain is increased from 40 up to about one wavelength height (75 mm) height but may start decreasing after that in another embodiment. Comparing the simulated results in curve 810 with the measured results in curve 820 of FIG. 8, it can be seen that simulation results follow the measurement results trend with good correlation.

According to yet another embodiment of the present invention, a reconfigurable helical antenna structure is designed and implemented using shape memory alloy spring actuators. The height and therefore the pitch spacing of the helical antenna is controlled by applying a DC current to the SMA spring, that causes it to shrink and therefore apply a downward force to the helical antenna to decrease pitch spacing. Using these variations in the height of the helical antenna, various pattern configurations can be attained, i.e., the gain and HPBW of the helical antenna can be tuned. In addition, null steering can also be implemented to reduce interference. This can be in particular useful in the broadside plane (the theta=90 plane) where the signal power is the lowest and therefore sensitivity to strong interferences is the highest.

In another embodiment, observations from the simulation results and physical measurements for both regular and conical helical antenna with swept height as well as experimental results for the proof-of-concept implemented antenna prototypes confirm the basic empirical relations for the axial mode helix antenna structure expressed in the Kraus reference listed below. In such embodiment, the directivity of the exemplary axial mode helical antenna substantially fits the Kraus directivity equation apart from some oscillations which may be expected from the surface wave radiation in certain helical antenna embodiments as tested and/or simulated. In such embodiments, the axial mode is dominant over a very wide range of helix pitch angles which correspond to the range of antenna helix heights which may be adjusted in the reconfigurable axial mode helical antenna embodiments of the invention. The experimental results described above and illustrated in the above-mentioned figures demonstrate reconfigurable axial-mode helical antenna embodiments according to the invention that can maintain a reasonable impedance match and axial ratio over a wide range of height variations which may be adjusted by reconfiguring the height of the helical antenna by means of an actuator, such as an SMA spring actuator 520, as described in particular embodiments above. In embodiments implementing a dual helix antenna structure, the antenna beam may be reconfigured to allow beam squint, such as by mutual reconfiguration of the heights of both helix antenna elements in the dual helix antenna structure. Some practical considerations may be drawn from the simulated and measured antenna propagation properties and patterns described above to desirably optimize the mechanical configuration of the novel reconfigurable axial-mode helical antenna according to several embodiments.

Figure 9:
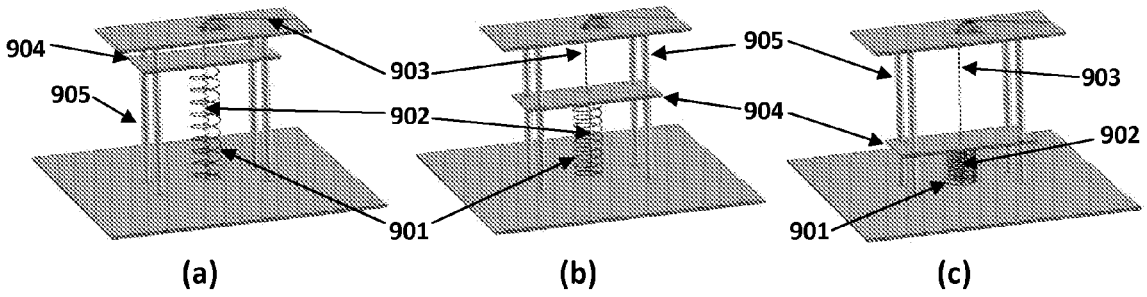
FIG. 9A illustrates a pictorial view of a reconfigurable axial-mode helical antenna in a first substantially extended position according to an exemplary embodiment of the present invention.
FIG. 9B illustrates a pictorial view of a reconfigurable axial-mode helical antenna in a second intermediate position according to an exemplary embodiment of the invention.
FIG. 9C illustrates a pictorial view of a reconfigurable axial-mode helical antenna in a third substantially contracted position according to an exemplary embodiment of the invention.

In a further embodiment, a pictorial view of a reconfigurable axial-mode helical antenna in a first substantially extended position is illustrated in FIG. 9A, comprising a helicoidal antenna element 901 actuated by an exemplary Shape Memory Alloy (SMA) actuator 902. The helicoidal antenna 901 and SMA actuator 902 are both connected at one end to an end tab 904 which is operable to move axially along slot 905 to maintain the orientation of the helicoidal antenna 901 upon extension or contraction of the SMA actuator 902 to effect changes in the height of the antenna 901. Exemplary SMAs may desirably be smart materials, which change shape when a variation of temperature is imposed, and preferably may also return to their original shape when a temperature variation is reversed (e.g. exhibit little hysteresis). In some embodiments, investigations were performed using commercial SMA springs having a threshold temperature of about 90 degrees C., such as Biometal™ Springs which may be commercially obtained from the Toki Corporation, for example. In one embodiment, temperature increase may be obtained by Joule effect; temperature decrease may be controlled by thermal flow exchange with the environment. The exemplary SMA spring actuator 902, which is shown in FIG. 9A, contracts when 90 degrees C. is reached, such as by Joule heating from passing a DC electrical current through the SMA spring actuator 902. In some embodiments, the actuator 902, however, may not be capable to recover its initial shape when it is cooled down; it may need, in fact, a small compression force provided, by an elastic element 903. FIG. 9A shows the exemplary reconfigurable axial-mode helical antenna in an initial substantially extended position, in which the SMA spring actuator 902 is in its elongated state and the elastic element 903 is in its contracted state. In FIG. 9A the helicoidal antenna 901 is stretched and its pitch is maximized.

FIG. 9B illustrates a pictorial view of the same reconfigurable axial-mode helical antenna structure as shown in FIG. 9A, but in a second intermediate position. The antenna structure in FIG. 9B corresponds to a partial contraction of the SMA spring actuator 902 which reduces the height and decreases the pitch of the helicoidal antenna 901, while partially extending the elastic element 903.

FIG. 9C illustrates a pictorial view of the same reconfigurable axial-mode helical antenna structure as shown in FIGS. 9A and 9B, but in a third substantially contracted position. The antenna structure in FIG. 9C corresponds to a substantially complete contraction of the SMA spring actuator 902 (such as by application of a DC electrical current to heat the actuator 902 via Joule heating) which minimizes the height and pitch of the helicoidal antenna 901, and fully extends the elastic element 903. Reducing or removing the DC current from the SMA spring actuator 902 may then cause relaxation or extension of the actuator 902, which may be assisted by the elastic element 903 in returning to a partially or substantially extended position, respectively.

Figure 10:
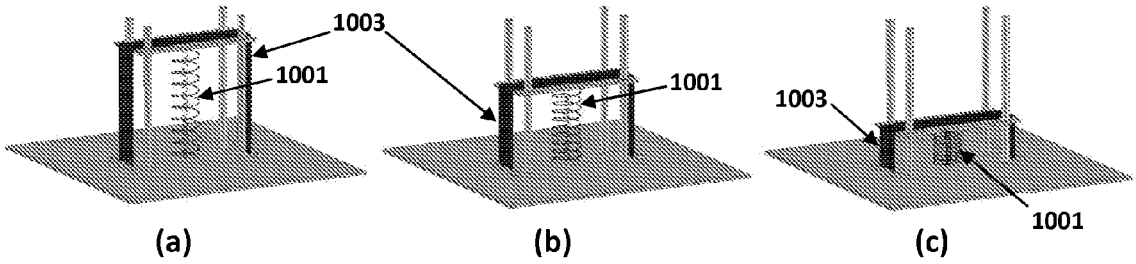
FIG. 10A illustrates a pictorial view of a reconfigurable axial-mode helical antenna with a helicoidal SMA antenna element in a first substantially contracted position according to another exemplary embodiment of the present invention.
FIG. 10B illustrates a pictorial view of a reconfigurable axial-mode helical antenna with a helicoidal SMA antenna element in a second intermediate position according to an exemplary embodiment of the invention.
FIG. 10C illustrates a pictorial view of a reconfigurable axial-mode helical antenna with a helicoidal SMA antenna element in a third substantially extended position according to an exemplary embodiment of the invention.

In other embodiments, different other prototypes have been developed to investigate alternative implementations of the present invention. For instance, FIG. 10A shows a pictorial view of a reconfigurable axial-mode helical antenna with a helicoidal SMA antenna element 1001 (the antenna element 1001 is itself made of an SMA material and thereby functions as an SMA spring actuator) in a first substantially contracted position, according to a further embodiment of the invention. In this case, an SMA spring antenna element 1001 may be selected that elongates when its temperature is above 90° C., for example. Contraction of the SMA antenna 1001 may be achieved and/or assisted by an elastic element 1003, represented, in the embodiment illustrated in FIG. 10A, by an elastic (such as rubber) band.

FIG. 10B illustrates a pictorial view of the same reconfigurable axial-mode helical antenna with a helicoidal SMA antenna element 1001 as shown in FIG. 10A, but in a second intermediate position according to an exemplary embodiment of the invention. The antenna structure in FIG. 10B corresponds to a partial extension or elongation of the SMA spring antenna 1001 which increases the height and correspondingly also increases the pitch of the helicoidal SMA antenna 1001, while partially extending the elastic element 1003.

FIG. 10C illustrates a pictorial view of the same reconfigurable axial-mode helical SMA antenna element 1001 as shown in FIGS. 10A and 10B, but in a third substantially extended or elongated position. The SMA antenna 1001 in FIG. 10C corresponds to a substantially complete extension or elongation of the SMA spring antenna 1001 (such as by application of a DC electrical current to heat the antenna 1001 beyond its transition temperature via Joule heating) which maximizes the height and pitch of the helicoidal antenna 1001, and fully extends the elastic element 1003. Reducing or removing the DC current from the SMA spring antenna 1001 may then cause relaxation or contraction of the antenna 1001, which may be assisted by the elastic element 1003 in returning to a partially or substantially contracted position, respectively.

In one embodiment of the present invention, the present reconfigurable helical antenna allows the miniaturization of the proposed antenna system that could potentially be embedded on portable devices (e.g. cell-phones or other mobile communication devices, for example), such as by the use of miniaturized helical antenna element and actuator components to provide for a miniaturized reconfigurable helical antenna as may be desirable for mobile or other miniaturized applications, for example.

In yet further embodiments of the present invention, novel smart polymeric materials such as electro-active polymers may be used as an actuator element for actuating a reconfigurable helical antenna, such as to change the length of the helical antenna element. In such embodiments, these smart materials, called Electro-Active Polymers (EAPs), can change dimension/shape in response to an electrical stimulus, such as a voltage or current, for example. Such EAPs may be classified in two main categories: 1) Ionic EAPs, which are activated by an electrically-induced transport of ions or molecules; and 2) Electronic EAPs, which are activated by an external electric field and Coulombian forces. Several EAP sub-groups belong to these categories as shown in Table 1.

TABLE 1

| EAP classification | |
|---|---|
| Mechanism of activation | Materials |
| Mass/ion transport -Ionic EAPS- | Conducting polymers<br>Polyelectrolyte gels<br>Ionic polymer-metal composites<br>Carbon nanotubes |
| Electric field -Electronic EAPS- | *Dielectric elastomers*<br>Piezoelectric polymers<br>Electrostrictive polymers<br>Liquid crystal elastomers |

In one embodiment, dielectric elastomers (see Table 1) may be selected as a suitable smart polymer and to act as an actuator element to expand and/or contract a helical antenna element to provide a reconfigurable helical antenna according to an embodiment of the invention. Such dielectric elastomers may typically generate strains proportional to the square of the electric field applied between two compliant electrodes, located on the opposite faces of a film of the elastomer. Dielectric elastomers (DEs) may be capable of exerting high forces compared to other EAPs, have a robust and reliable behaviour, and can operate in harsh environments such as in space, for example. Such DE materials may desirably be inexpensive and suitable for embedding in compliant structures. In one embodiment, DEs may be used in simple actuating devices, called dielectric actuators, which may be used to produce high strain, large force density, low response time, and have a long lifetime. Accordingly, DE actuators may be used in one embodiment of the present invention to provide a mechanically tunable reconfigurable helical antenna that synergistically takes advantage of both SMA and EAP materials to suitably change its shape such as during operation, for example. In one such embodiment, any suitable electro-active polymer material may be used to form an electro-active polymer actuator element for reconfiguring a helical antenna according to the invention.

The above description of exemplary embodiments of the present invention, including what is described in references identified below, is not intended to be exhaustive or to limit the embodiments of the invention to the precise forms disclosed herein. Although specific embodiments and examples are described herein for illustrative purposes and to allow others skilled in the art to comprehend their teachings, various equivalent modifications may be made without departing from the scope of the disclosure, as will be recognized by those skilled in the relevant art.

References noted in the above description and listed below are herein incorporated in their entirety as though they formed part of the present description:

[1] J. D. Kraus, "The Helical Antenna," *Proceedings of the IRE*, Vol. 37, No. 3, pp. 263-272, March 1949

[2] Wilson, "Spring Tunable Helical Whip Antenna," August 1979, U.S. Pat. No. 4,163,981.

[3] Killen, "Variable Pitch Angle, Axial Mode Helical Antenna," April 1999, U.S. Pat. No. 5,892,480.

[4] C. Chen, E. Yung, B. Hu, and S. Xie, "Axial mode helix antenna with exponential spacing," *Microwave and Optical Technology Letters*, vol. 49, no. 7, pp. 1525-1530, 2007.

[5] Y. Zhang, "Design of tri-band (EGSM/GPS/PCS) antenna with parasitic element for mobile-phone application," *Microwave and Optical Technology Letters*, vol. 48, no. 7, pp. 1347-1350, 2006.

[6] Roscoe, D. J., Shafai, L., Ittipiboon, A., Cuhaci, M., and Douville, R., "Tunable dipole antennas," *Proc. IEEE/URSI Int. Symp. Antennas and Propagation*, vol. 2, pp. 672-675, 1993.

[7] J. Kiriazi, H. Ghali, H. Radaie, and H. Haddara, "Reconfigurable dual-band dipole antenna on silicon using series MEMS switches," *Proc. IEEE/URSI Int. Symp. Antennas and Propagation*, vol. 1, pp. 403-406, 2003.

[8] J. T. Bernhard, "Reconfigurable Antennas," Morgan & Claypool Publishers, 2007.

[9] J. T. Bernhard, E. Kiely, and G. Washington, "A smart mechanically-actuated two-layer electromagnetically coupled microstrip antenna with variable frequency, bandwidth, and antenna gain," *IEEE Trans. Antennas and Propagation*, vol. 49, pp. 597-601, April 2001.

[10] A. Mahanfar, C. Menon, and R. G. Vaughan, "Smart antennas using electro-active polymers for deformable parasitic elements, IET Electronic Letters, 2008.

[11] BMX Biometal springs datasheet, Toki, Japan, http://www.toki.co.jp/BioMetal/

[12] S. H. Mandavi and P. J. Bentley, "Evolving noise tolerant antenna configurations using shape memory alloys," in *Proc. 2nd Int. Conf. on Comp. Intel., Robotics and Auton. Sys.* (CIRAS 2003), December 2003.

[13] J. S. Chatterjee, "Radiation Field of a Conical Helix", J. Appl. Phys. 24, 1953.

[14] G. Song, B. Kelly, and B. N. Agrawal, "Active position control of a shape memory alloy wire actuated composite beam," *J. Smart Materials and Structures,* 2000.

[15] J. Jayender, R. V. Patel, N. Nikumb, and M. Ostojic, "Modeling and control of shape memory alloy actuators," *IEEE Trans. Control Systems Tech., vol.* 16, no. 2, March 2008.

[16] H. King and J. Wong, "Characteristics of 1 to 8 wavelength uniform helical antennas," *IEEE Trans. Antennas Propag.*, vol. 28, no. 3, pp. 291-296, March 1980.

[17] J. D. Kraus, *Antennas*, McGraw-Hill, 2nd Ed., 1988.

[18] J. D. Kraus, "Helix beam antennas for wideband applications," *Proc.IRE*, vol. 37, no. 3, pp. 263-272, March 1949.

What is claimed is:

1. A reconfigurable helical antenna apparatus, comprising:

a conductive antenna element formed in a substantially helical shape and comprising first and second ends and a plurality of turns;

an electrically controllable actuator element comprising first and second ends, wherein said first end of said actuator element is attached to said first end of said antenna element;

wherein said actuator element is operable to continuously vary a length of said antenna element by moving said first end of said antenna element relative to said second end of said antenna element in response to an electrical signal, and thereby to continuously vary a spacing between said turns of said antenna element.

2. The reconfigurable helical antenna apparatus according to claim 1, additionally comprising a substantially non-conductive core element, wherein said core element is situated substantially within said helical antenna element.

3. The reconfigurable helical antenna apparatus according to claim 2, additionally comprising a tab element attached to said first ends of said antenna and said actuator elements, wherein said tab element is rotationally constrained within a substantially linear slot disposed in said core element, and is operable to prevent relative rotation of said antenna element upon variation of said length of said antenna element by said actuator.

4. The reconfigurable helical antenna apparatus according to claim 1, wherein said actuator element is further operable to continuously vary a pitch angle of said helical antenna element by moving said first end of said antenna element relative to said second end of said antenna element in response to an electrical signal.

5. The reconfigurable helical antenna apparatus according to claim 1, wherein said continuous variation of said length of said antenna element is operable to vary at least one propagation characteristic of said antenna element.

6. The reconfigurable helical antenna apparatus according to claim 1, wherein said reconfigurable helical antenna apparatus comprises a reconfigurable axial-mode helical antenna apparatus.

7. The reconfigurable helical antenna apparatus according to claim 1, wherein said actuator element comprises an electro-mechanically controllable smart material.

8. The reconfigurable helical antenna apparatus according to claim 1, wherein said actuator element comprises a shape memory alloy spring actuator, and wherein said shape memory alloy spring actuator is operable to continuously vary said length of said antenna element in response to at least one of relative heating and cooling of said shape memory alloy spring element using an electrical current.

9. The reconfigurable helical antenna apparatus according to claim 8, wherein said shape memory alloy comprises a nickel-titanium shape memory alloy.

10. The reconfigurable helical antenna apparatus according to claim 1, wherein said actuator element comprises an electro-active polymer actuator, and wherein said electro-active polymer actuator is operable to continuously vary said length of said antenna element in response to at least one of an electrical voltage and an electrical current.

11. The reconfigurable helical antenna apparatus according to claim 10, wherein said electro-active polymer comprises a dielectric elastomer.

12. The reconfigurable helical antenna apparatus according to claim 1, wherein said antenna element comprises a first antenna element, and additionally comprising at least a second conductive antenna element formed in a substantially helical shape and comprising first and second ends and a plurality of turns, wherein said actuator element is operable to continuously vary a length of at least one of said first and second conductive antenna elements.

13. The reconfigurable helical antenna apparatus according to claim 12, wherein said actuator element is further operable to continuously vary a pitch angle of at least one of said first and second helical antenna elements by moving a first end of said at least one antenna element relative to a second end of said at least one antenna element in response to an electrical signal.

14. The reconfigurable helical antenna apparatus according to claim 1, additionally comprising a ground plane element, wherein said second ends of said antenna and said actuator elements are attached to said ground plane element.

* * * * *